United States Patent [19]

Ching

[11] Patent Number: 5,033,751

[45] Date of Patent: Jul. 23, 1991

[54] PYRAMIDAL TYPE QUAD LEVEL CHECKERED GAMEBOARD AND GAME

[76] Inventor: Edward J. Ching, 50 S. Beretania St., Ste. C113, Honolulu, Hi. 96813

[21] Appl. No.: 606,167

[22] Filed: Oct. 31, 1990

[51] Int. Cl.[5] ..... A63F 3/00

[52] U.S. Cl. ..... 273/241; 273/285; 273/282; D21/23

[58] Field of Search ..... 273/241, 261, 260, 282 R, 273/285; D21/23, 24, 33, 34

[56] References Cited

U.S. PATENT DOCUMENTS

D. 255,910 7/1980 Bergman ..... D21/23

FOREIGN PATENT DOCUMENTS 2592809 7/1987 France ..... 273/241

*Primary Examiner*—Benjamin Layno

*Attorney, Agent, or Firm*—Michael I. Kroll

[57] ABSTRACT

A multi-tier checkered gameboard having rows and columns, is disclosed. The multi-tier checkered gameboard includes a first tier which includes 8 rows and 8 columns of 64 equal sized squares. The 64 equal sized squares alternate in color from clear to tinted. A second tier having a center with a hole and is displaced a distance above the first tier, and includes 4 rows and 4 columns of 16 equal sized squares, the 16 equal sized squares alternates in the color from the clear to the tinted. A third tier having the center with the hole and is displaced the distance above the second tier, the includes 2 rows and 2 columns of 4 equal sized squares, the 4 equal sized squares alternate in the color from the clear to the tinted. A fourth tier displaced a distance above the third tier, and including 1 square, the square being the color of clear.

8 Claims, 2 Drawing Sheets

Fig. 2

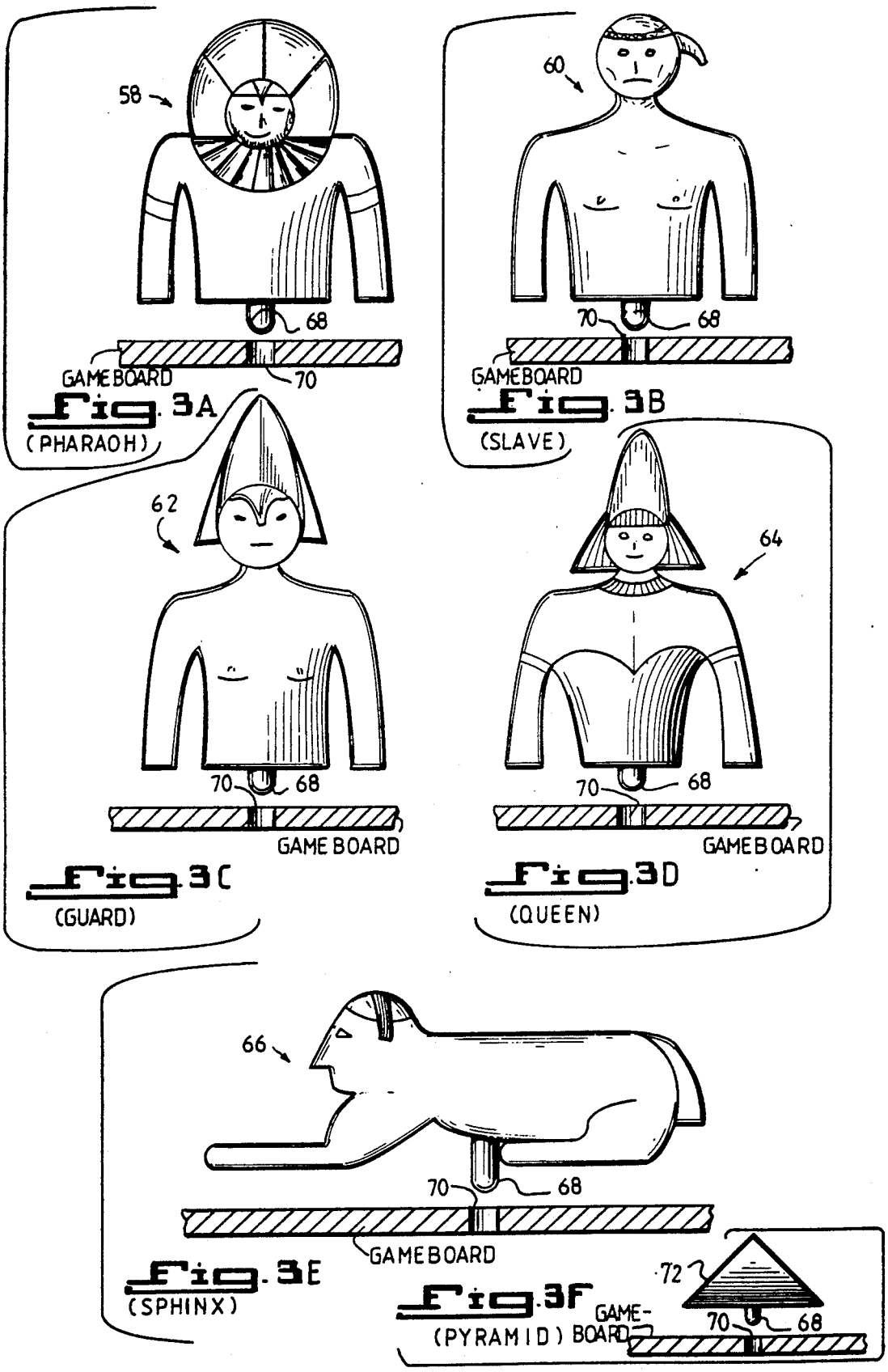
Fig. 3A (PHARAOH)
Fig. 3B (SLAVE)
Fig. 3C (GUARD)
Fig. 3D (QUEEN)
Fig. 3E (SPHINX)
Fig. 3F (PYRAMID)

PYRAMIDAL TYPE QUAD LEVEL CHECKERED GAMEBOARD AND GAME

BACKGROUND OF THE INVENTION

1. Field of the Invention

The present invention relates to a checkered gameboard.

More particularly, the present invention relates to a pyramidal type quad level checkered gameboard.

2. Description of the Prior Art

Many avenues of recreation are sought after. Most simple are the board games. Board games may involve a number of players each competing to be the winner. However, the average board game involves a lot of playing pieces, intricate rules, scoring conditions, and some means for determining the advancement of each player.

The game of chess, played on a game board of alternatingly colored dark and light squares of eight squares on a side, has origins lost in antiquity. In modern times, there have been attempts to "improve" the game by changing the character of the playing pieces or the rules of the game.

Multi-level game boards are known for a variety of purposes.

U.S. Pat. No. 3,656,755 to Thompson teaches a checker game having five identical vertically spaced game boards each shaped in the form of a pentagon divided into triangular playing areas.

U.S. Pat. No. 3,884,474 to Harper teaches a multi-tiered game board for playing a variation of the game of tic-tac-toe.

U.S. Pat. No. 3,804,416 to Jones teaches a multi-tiered game board with apertures or sockets for receiving movable playing pieces.

U.S. Pat. No. 3,897,063 to Lehwalder teaches a multi-tiered set of checker boards for playing a number of games simultaneously.

Numerous innovations for game boards have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a pyramidal type checkered gameboard that avoids the disadvantages of the prior art.

More particularly, it is an object of the present invention to provide a pyramidal type checkered gameboard wherein Pyramidal means that each higher consecutive tier diminishes in size by one column and by one row of squares until the top tier of the gameboard includes only one square that is centered over the lower tiers. The tiers of the present invention gameboards are square, can contain any amount, and are connected at the centers by screwable connecting rods or the like means.

The present invention is designed as a Pyramidal Type Quad Level checkered gameboard game. Pyramidal meaning that each higher level diminishes in size by one column and one row of squares until the top of the gameboard contains only one square connected at the center of each surface by means of support by solid or collapsible connecting rods (telescopic screwable connecting rods). Game playing pieces are placed on the surfaces of the gameboards, in the way, specified by the set of game playing rules.

Game playing pieces are provided to be placed on the tiers of the gameboard and to be strategically moved to manipulate an opponent's game piece in a way specified by the set of game playing rules.

The game of the present invention includes a Pyramidal Type Quad Level Checkered Gameboard, as shown in FIG. 1, thirty six playing pieces as shown in FIGS. 3A through 3F. Eighteen pieces are dark or tinted in color and eighteen pieces are light or clear in color, and its unique game rules designed for play. The PYRAMID Chess Gameboard consists of 4 tiers. The first tier is located at the base and include 8 rows and 8 columns of 64 equal squares, alternating from clear to tinted in color. The second tier is centered two steps or squares directly above the first tier and includes 4 rows and 4 columns of 16 equal squares alternating from clear to tinted in color. The third tier is centered two steps or squares directly above the second tier and includes 2 rows and 2 columns of 4 equal squares alternating from clear to tinted in color. The fourth tier is centered one step or square directly above the third tier and includes one clear in color square.

The material used for the gameboards is a high grade acrylic, polymer or any solid material clear in color or the like.

A $\frac{1}{4}''$ hole is drilled through the center of tiers 1, 2, and 3. All cuts and drill holes are polished to prevent cracking or sharp edges. The fourth tier is connected as a solid piece or attached by a fastener. The squares alternating from clear to tinted in color are applied by silk screen frosted spray, etching or like means.

The gameboards are connected by three cast acrylic telescopic connecting rods. The connecting rods between tier 1, 2, and 3 have holes drilled into each end. They are then threaded with a threading tap or injection molded with threads. The connecting rod between tiers 3 and 4 is glued to the center of tier 4 and the opposite end is drilled and threaded like the previous connecting rods.

An attaching screw is placed between tier 1 and tier 4 into the connecting rods so that the gameboards may be assembled and disassembled quickly.

The straight edges of each tier should be parallel to each other and the color coordination of squares on the vertical should be aligned uniformly with each tier. The playing surfaces of the gameboards are essential to the present invention.

Each tier is considered a level. The levels are referred to as I, II, III, and IV starting Level 1 from the bottom.

The eight adjacent squares of the lower level on the inside edge nearest the player with the clear game pieces moving toward the other player with the tinted pieces are ROWS, numbered from 1 through 8. To describe a square on paper, one would use a capital "R" followed by the number of the Row encased by parentheses. When addressing a square for a clear game piece, place the Row location first in the parentheses. For example (R1, ).

The eight adjacent squares on the outside left edge viewed from the side with the clear game pieces moving to the right are COLUMNS numbered from 1 through 8. To describe a square on paper one would use a capital "C" followed by the number of the column encased by parentheses. When addressing a square for a tinted game piece place the Column location first in the parentheses. For example, (C1,R1).

The adjacent squares moving from corner to corner, congruent in color, are DIAGONALS.

The squares directly above or below each other between tiers congruent in color, are VERTICALS.

The squares between one tier to another on a diagonal elevated slant congruent in color, are DIAGONAL OBLIQUES. For example, moving from the clear corner of tier 1 "I(R1-C8) to the opposite corner of tier "III(R5-C4) would be a DIAGONAL OBLIQUE move.

The squares between one tier to another on a vertical elevated slant congruent in color, are VERTICAL OBLIQUES. For example, moving from the clear Queens square "I(R1,C4)" to the third tier far left corner, "III(R5,C4)" would be a VERTICAL OBLIQUE move.

The game pieces are Egyptian characters molded from clear acrylic and consist of two sets of the same pieces, one clear set and one tinted set. Each color includes one PHARAOH, one QUEEN, two PYRAMIDS, two SPHINXS, four GUARDS, and eight SLAVES. These pieces are illustrated in FIGS. 3A through 3F.

A manipulative standard of allowable moves are essential to the playing of the game. The game is ultimately won when one of the two players captures their opponents PHAROH or all of an opponents gamepieces are captured leaving the PHAROH or all of an opponents gamepieces are captured leaving the PHAROH alone. The strategy of the game is to continuously plot and plan several moves in advance as to how you will capture your opponent's PHARAOH or any of his other game pieces without losing one's own.

It is also to a players advantage to control the top half of the gameboard surfaces. At the start of a game, assign the clear game pieces to the player who moves first. The players alternate turns when moving their game pieces. To move, the player takes a game piece from the square it is on and places it in a desired legal square. The SPHINX is the only game piece allowed to travel over another game piece. Any other game piece is prevented from moving if there is another game piece in its path, or in the square desired to be occupied.

The only time a game piece may move into a square occupied by his opponent, is if he plans to capture the game piece and place his game piece in that square. Once a game piece is touched, it must be moved.

The PHARAOH may move one square each turn on a single level in any direction from the square he occupies. He is able to move between tiers, however, only one tier each turn on the VERTICAL OBLIQUE or DIAGONAL OBLIQUE. The PHARAOH captures in the same manner. In addition he may "PYRAMID". "PYRAMIDING is accomplished by moving the PHARAOH 2 squares on the same row to the left or right of the original square he was standing on, then placing the PYRAMID game piece on the square closest to the PHARAOH on the opposite side from where the PYRAMID game piece originated.

PYRAMIDING may not be done if the PHAROH or the PYRAMID game pieces intended to be used has been moved, if the row of squares between the PHAROH and the PYRAMID game pieces have any game pieces in its path, or if the squares on and between the PHARAOH and the intended PYRAMID game pieces are reachable by an opposing game piece.

The QUEEN may move any amount of squares in a turn on a Row, Column, Diagonal, Vertical, Vertical Oblique or Diagonal Oblique from the square she occupies. The QUEEN captures in the same manner.

The PYRAMID may move any amount of squares in a turn on a Row, Column, Vertical, or Vortical Oblique from the square he occupies. The PYRAMID captures in the same manner The SPHINX may move in a "L"-shaped manner consisting of two squares on a Row, Column, Vertical, and then one square in the opposite (the opposite of a Row is a Column, or vertical, and vice-versa). The opposite of a Vertical is either a Row or a Column. The SPHINX captures in the same manner. Remember the SPHINX is the only game piece that may travel over the path of another game piece to occupy a square The GUARD may move any amount of squares in a turn on the Diagonal or Diagonal Oblique within the designated color of square he is occupying from the start of the game. The GUARD captures in the same manner. Designated color changing is possible anytime by making a Diagonal Oblique move from tier 3 to tier 4 in a turn, from its original color. Then in another turn move Diagonally Oblique back down to tier 3, to the opposite color.

The SLAVE may move one square in a turn in the same column forward from the square he occupies. Unless it is his first move from the first, second, or third tier, then he may move two squares in a turn forward on the first tier in the same column, or if he is originating from Columns 3 through 5 he may proceed to a higher level. If a SLAVE chooses to move forward once on a higher level instead of upwards, he must then move one square in a turn forward to the end of that tier and proceed down to the end of the next lower tier, in a turn until reaching the lower level, and then procede forward one square in a turn.

If a SLAVE originating from column 4 or 5 reaches tier 4, he is then promoted to a GUARD. If any SLAVE reaches the row where his opponent's PHARAOH and QUEEN originated from, he then may choose to be replaced by any game piece that has been previously captured.

The SLAVE captures one square diagonally forward from the square he occupies in a turn separate from his forward movement. The only square he may capture and move simultaneously to is when moving diagonally Oblique from tier 3 to tier 4, or while moving downward from a higher level.

In keeping with these objects, and with others which will become apparent hereinafter, one feature of the present invention resides, briefly stated, in an at least one checkered gameboard having at least one row and at least one column. At least a first tier includes at least one row and at least one column of at least one equal sized squares, the at least one equal sized squares alternate in color from clear to tinted. At least one subsequent tier having a center with a hole and being displaced a distance above the at least first tier, if applicable, includes at least one row and at least one column of at least one sized squares, the at least one, if applicable, equal sized squares alternate in color from clear to tinted. At least one subsequent tier has the center with the hole and is displaced a distance above the at least second tier, if applicable, and includes at least one row and at least one column, of at least one subsequent sized squares. The at least one, if applicable, square alternating in color from clear to tinted, and a fourth tier displaced the distance above the third tier includes one square, the square being the color of clear.

In accordance with another feature of the present invention, it further comprises a telescopic central displacement rod, or the like.

Another feature of the present invention is that the central displacement rod includes a lower section, an intermediate section, and an upper section.

Yet another feature of the present invention is that the lower section is affixed to the center of the lower tier, by a fastener or like means.

Still another feature of the present invention is that the intermediate section and the upper section pass through the center hole in the second tier and the third tier.

Yet still another feature of the present invention is that the upper section is affixed to the center of the upper tier, by a fastener or like means.

Still yet another feature of the present invention is that the fastener is a screw, or the like.

Another feature of the present invention is that the first tier, the second tier, the third tier, and the fourth tier are all parallel and central to each other as they remain attached to the central displacement rod.

Yet another feature of the present invention is that the first tier, the second tier, the third tier, and the fourth tier are acrylic, glass, wood, metal or the like.

Another feature of the present invention is that the tinted squares are tinted by another manner known in the art.

Still another feature of the present invention is that the tinted squares are silk screened, sprayed, etched or like means known in the art.

Yet still another feature of the present invention is that the central displacement rod is acrylic, glass, wood, metal or any known solid substance known to man.

Another feature of the present invention is that game is ultimately won when one of the two players captures the opponents Pharaoh or all of the opponent's game pieces, such game pieces being the Queen, Guards, Sphinxs, Slaves, and PYRAMID are captured and leave just the Pharaoh.

Yet another feature of the present invention is that one controls the top half of the playing surfaces.

Still another feature of the present invention is that at the start of the game, clear game pieces are assigned to one of the two players who then moves first.

Yet still another feature of the present invention is that at least two players alternate turns when moving the game pieces.

Still yet another feature of the present invention is that when the player moves the game piece and takes the game piece from the square it is in and places it in the desired legal square.

Another feature of the present invention is that sphinx is only gamepiece allowed to travel over another game piece.

Yet another feature of the present invention is that all other game pieces, except the Sphinx, are prevented from moving if there is another game piece in its path or in the square desired to be occupied.

Yet another feature of the present invention is that players take turns moving a gamepiece.

Still another feature of the present invention is that the only time a game piece may move into the square that is occupied by the opponent is if he plans to capture the game piece and place his the game piece in the square.

Yet still another feature of the present invention is that once the game piece is touched it must be moved.

Still yet another feature of the present invention is that the Pharaoh may move one square in a turn on a single tier in any direction from the square it occupies.

Another feature of the present invention is that the Pharaoh is able to move between tiers, however, only one tier in a turn on the Vertical Oblique or the Diagonal Oblique.

Yet another feature of the present invention is that Pyramiding is accomplished by moving the Pharaoh two squares on the same row to the left or right from the original square he stands on, and then placing the Pyramid game piece on the square closest to the Pharaoh on the opposite side from where the Pyramid game piece originated.

Still another feature of the present invention is that Pyramiding may not be done if the Pharaoh or the Pyramid game piece intended to be used has been moved, or if the rows of squares between the Pharaoh and Pyramid game piece has game pieces in its path, and if squares on and between the Pharaoh and the intended Pyramid game piece are reachable by the opposing game piece.

Yet still another feature of the present invention is that the Queen may move any amount of squares in a turn on a Row, Column, Diagonal, Vertical, Vertical Oblique, or Diagonal Oblique from the square it occupies.

Still yet another feature of the present invention is that the Pyramid may move any amount of squares in a turn on a Row, Column, Vertical or Vertical Oblique from the square it occupies.

Another feature of the present invention is that Sphinx may move in an "L"-shaped matter consisting of two squares on Row, Column, or Vertical, and then one square of the opposite, opposite of Row is Column and vice-versa.

Yet another feature of the present invention is that the opposite of Vertical is either Row or Column.

Still another feature of the present invention is that the Guard may move any amount of squares in a turn on a Diagonal, or on a Diagonal Oblique within the designated color of the square it is occupying from the start of the game.

Yet still another feature of the present invention is that designated color changing is possible anytime by making a Diagonal Oblique move from tier 3 to tier 4 in turn from its original color, in another turn moving a Diagonally Oblique back down to the tier 3 to the opposite color.

Still yet another feature of the present invention is that the slave may move one square in a turn in the same column forward from the square it occupies unless it is its first move from the first tier, second tier, or third tier, the Slaves by then may move two squares in a turn forward on the first tier in the same column, or if it is originating from Columns 3 through 5, it may proceed to a higher level.

Another feature of the present invention is that if the Slave chooses to move forward on a higher tier instead of upwards, he must then move one square in a turn forward to the end of that tier and proceed down to the next lower tier.

Yet another feature of the present invention is that if the Slave reaches the Row where his opponent's Pharaoh and Queen originated from, it then may choose to be replaced by any game piece that has been previously captured.

Still another feature of the present invention is that the Slave captures one square diagonally forward from the square he occupies in a turn, separate from forward movement.

Yet still another feature of the present invention is that the Slave can capture only one square when he is moving diagonally and simultaneously.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 3A is a front view of the PHARAOH playing piece;

FIG. 3B is a front view of the SLAVE playing piece;

FIG. 3C is a front view of the GUARD playing piece;

FIG. 3D is a front view of the QUEEN playing piece;

FIG. 3E is a front view of the SPHINX playing piece; and

FIG. 3F is a front view of the PYRAMID playing piece.

LIST OF REFERENCE NUMERALS UTILIZED IN THE DRAWING

Figures 1, 2, 3:
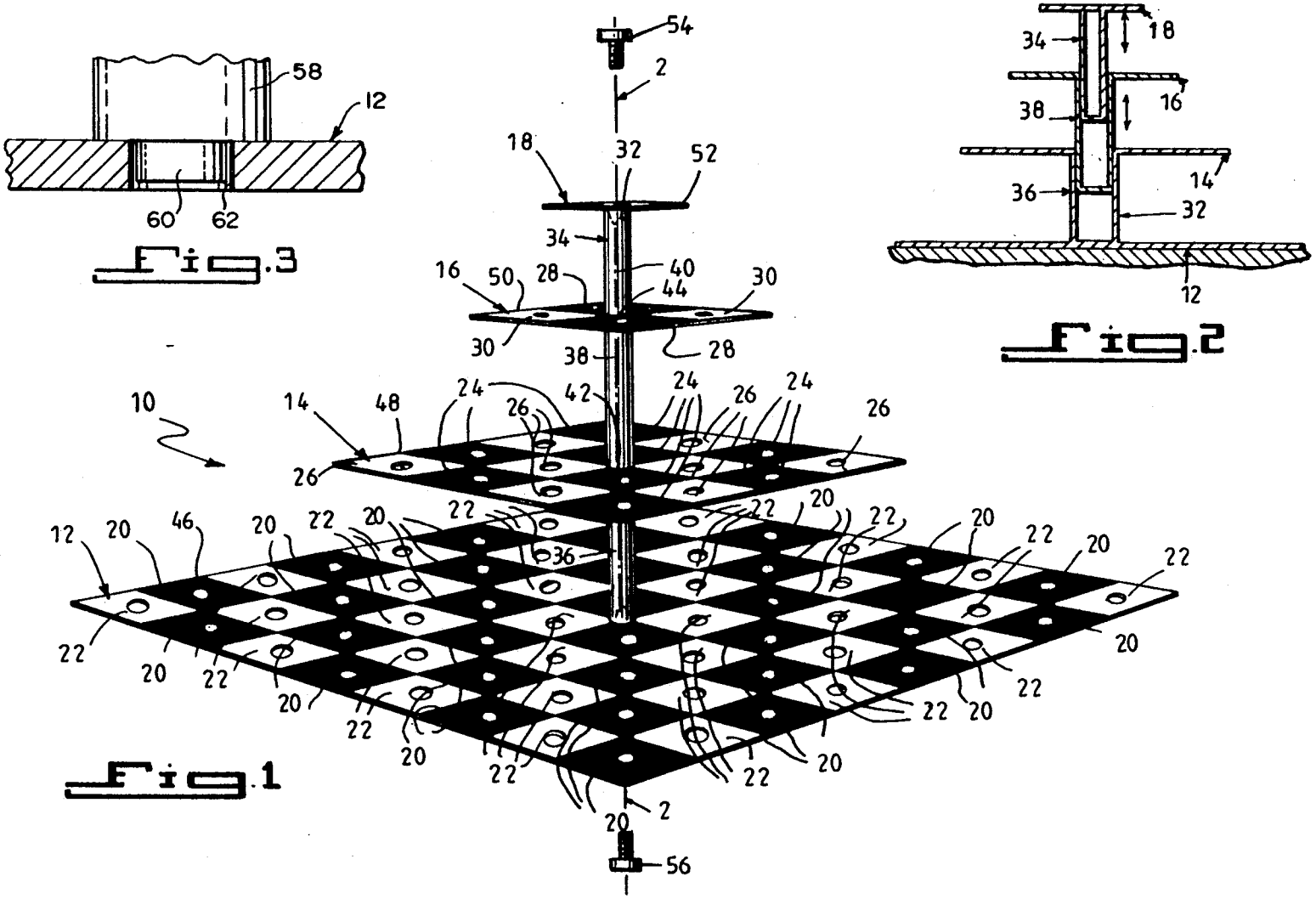
FIG. 1 is a perspective view of the present invention without the playing pieces.
FIG. 2 is a cross sectional view of the present invention taken in the direction of line 2—2 of FIG. 1.

10—checkered gameboard
12—parallel tier
14—parallel tier
16—parallel tier
18—parallel tier
20—black square
22—clear square
24—black square
26—clear square
28—black square
30—clear square
32—clear square
34—central telescopic displacement rod
36—lower section
38—intermediate section
40—upper section
42—central throughbore
44—central throughbore
46—third hole
48—playing surface
50—playing surface
52—playing surface
54—screw
56—screw
58—PHARAOH
60—SLAVES
62—GUARDS
62—QUEEN
66—SPHINXS
68—protrusion
70—aperture
72—pyramid

DETAILED DESCRIPTION OF THE PREFERRED EMBODIMENT

Referring now to FIG. 1 the pyramidal type level checkered gameboard of the present invention is shown generally as 10. The gameboard consists of at least one parallel tiers 12, 14, 16, and 18, displaced a distance from each other, as shown in FIG. 1. Four parallel tiers are being used as an example. It is to be noted that any number of parallel tiers can be used.

Tier 12 is larger than tier 14. Tier 14 is larger than tier 16, tier 16 is larger than tier 18 and the gameboard 10 is given the name "pyramidal".

Tier 12 includes an eight by eight, 64 square, matrix of alternating black 20 and clear 22 squares.

Tier 14 includes a four by four, 16 square, matrix of alternating black 24 and clear 26 squares.

Tier 16 includes a two by two, four square, matrix of alternating black 28 and clear 30 squares.

Tier 18 includes a one by one, one square, matrix of a clear square 32.

In order for the tiers 12, 14, 16, and 18 to remain parallel and centered to each other and be displaced from each other, telescopic central displacement rod 34 is provided. The central telescopic displacement rod 34, as shown in FIG. 2, includes three telescopic sections. The lower section 36, the intermediate section 38, and the upper section 40. The tier 14 contains a central throughbore 42 and the tier 16 contains a central throughbore 44.

The tier 12 is removably mounted to the lower section 36 of the central telescopic displacement rod 34, by a screw 54, shown in phantom.

The tier 14 contains a central throughbore 42 that slidingly receives the intermediate section 38 of the central telescopic displacement rod 34 into the proper position.

The tier 16 contains a central throughbore 44 that also slidingly receives the upper section 40 of the central telescopic displacement rod 34 into the proper position.

The tier 18 is removably mounted to the upper section 40 of the central telescopic displacement rod 34 by a screw 56, shown in phantom. With this approach, the gameboard 10 can be assembled and disassembled quickly.

The tiers 12, 14, 16, and 18 are made out of clear acrylic with alternating black 20, 24, and 28 and clear 22, 26, 30, and 32 squares. The black squares 20, 24, and 28 are silk screened or tinted by another manner known in the art on to the tiers 12, 14, 16, and 18. The connecting rod 34 is telescopically formed and is made out of clear acrylic, or the like.

The pieces used on the pyramidal type level checkered gameboard 10 of the present invention include thirty-six pieces consisting of a PHARAOH 58, a QUEEN 64, GUARDS 62, SPHINXS 66, SLAVES 60, and PYRAMID 72.

In order for the pieces PHARAOH 58, SLAVES 60, GUARDS 62, QUEEN 64, SPHINX 66, and PYRAMID 72 to remain on the first tier 12, the tier 14, the tier 16, and the tier 18 when playing the game, let's say, in a car, each black square and each white square contains an aperture 70 which receives a protrusion 68 disposed on the playing pieces. The protrusion 68 fits into the aperture 70, for a snug fit.

The playing surfaces 46, 48, 50, and 52 of the tiers 12, 14, 16, and 18, respectively, are essential to the present invention.

PRELIMINARIES

The eight adjacent squares on the inside edge nearest the player with the clear game pieces moving toward the other player with the tinted pieces are ROWS numbered from 1 through 8. To describe a square on paper, a capitol "R" followed by the number of the ROW encased by parentheses is used. When addressing a square for a clear game piece, place the ROW location first in the parentheses.

The eight adjacent squares on the outside left edge viewed from the side with the clear game pieces moving to the right are COLUMNS numbered from 1 through 8. To describe a COLUMN on paper a capitol "C" followed by the number of the COLUMN encased by parentheses is used. When addressing a square for a tinted game piece place the COLUMN location first in the parentheses.

The adjacent squares running from corner to corner that are the same in color are DIAGONALS.

The squares directly above or below each other, between tiers that are the same in color are the VERTICALS.

The squares between one level to another on a diagonal elevated slant that are the same in color are the DIAGONAL OBLIQUES.

The squares between one level to another on a vertical elevated slant that are the same in color are the VERTICAL OBLIQUES.

The game pieces are Egyptian characters molded into clear acrylic and consist of two sets of identically structured pieces, one clear set and one tinted set. Each set consists of one PHARAOH 58, one QUEEN 64, two PYRAMIDS, two SPHINXS 66, four GUARDS 62, and eight SLAVES 38.

RULES

The game is ultimately won when one of the two players captures the opponent's PHAROH 58 or all of an opponent's game pieces QUEEN 64, GUARDS 62, SPHINXS 66, and SLAVES 60 are captured leaving just the PHARAOH 58. The game involves continuously plotting and planning of several moves in advance so as how to capture the opponents PHARAOH 58 or any of his other game pieces QUEEN 64, GUARDS 62, SPHINXS 66, and SLAVES 60. It is also to a players advantage to control the top half of the playing surfaces 46, 48, 50, and 52.

At the start of a game assign the clear game pieces to the player who moves first. The players alternate turns when moving the game pieces PHARAOH 58, QUEEN 64, GUARDS 62, SPHINXS 66, SLAVES 60, and PYRAMID 72. To move, the player takes a game piece from the square it is in and places it in a desired legal square. The SPHINX 66 is the only game piece allowed to travel over another game piece. Any other game piece is prevented from moving if there is another game piece in its path, or in the square desired to be occupied. The only time a game piece may move into a square occupied by his opponent is if he plans to capture the game piece and place his game piece in that square. Once a game piece is touched, it must be moved.

The PHARAOH 58 may move one square in a turn on a single tier in any direction from the square it occupies. The PHARAOH 58 is able to move between tiers, however, only one tier in a turn on the VERTICAL OBLIQUE or DIAGONAL OBLIQUE. The PHARAOH 58 captures in the same manner.

In addition, the PHARAOH 58 may "PYRAMID". "PYRAMIDING" is done by moving the PHARAOH 58 two squares on the same ROW to the left or right from the original square he stands on, and then placing the PYRAMID game piece on the square closest to the PHARAOH 58 on the opposite side from where the PYRAMID game piece originated. PYRAMIDING may not be done if the PHARAOH 58 or the PYRAMID game piece intended to be used has been moved, or if the ROW of squares between the PHARAOH 58 and the PYRAMID game piece has game pieces in its path, and if the squares on and between the PHARAOH 58 and the intended PYRAMID game piece are reachable by an opposing game piece.

The QUEEN 64 may move any amount of squares in a turn on a ROW, a column, a diagonal, a vertical, a vertical oblique, or a diagonal oblique, from the square it occupies. The QUEEN 64, captures in the same manner.

The PYRAMID may move any amount of squares in a turn on a ROW, a column, a vertical, or a vertical oblique from the square it occupies. The PYRAMID, captures in the same manner.

The SPHINX 66 may move in an "L"-shaped manner consisting of two squares on a ROW, a column, or a vertical, and then one square of the opposite. The opposite of a ROW is a column and vise-versa. The opposite of a vertical is either a ROW, or a column. The SPHINX 66 captures in the same manner. The SPHINX 66 is the only game piece that may travel over the path of another game piece to occupy a square.

The GUARD 62 may move any amount of squares in a turn on the diagonal, or on the diagonal oblique within the designated color of the square it is occupying from the start of the game. The GUARD 62 captures in the same manner. Designated color changing is possible anytime by making a diagonal oblique move from tier 18 to tier 16 in a turn from its original color. Then in another turn moving diagonally oblique back down to the tier to the opposite color.

The SLAVE 60 may move one square in a turn in the same column forward from the square it occupies, unless it is its first move from the first tier 12, second tier 14, or third tier 16. Then the SLAVE 60 may move two squares in a turn forward on the first tier 12 in the same column, or if it is originating from columns 3 through 5, it may proceed to a higher level. If a SLAVE 60 chooses to move forward on a higher tier instead of upwards, he must then move one square in a turn forward to the end of that tier and proceed down to the next lower tier.

If a SLAVE 60 originating from column 3 and 4 succeeds in reaching tier 4, it is then promoted to a GUARD 62. If a SLAVE 60 reaches the ROW where his opponent's PHARAOH 58 and QUEEN 64 originated from, it then may choose to be replaced by any game piece that has been previously captured. The SLAVE 60 captures one square diagonally forward from the square he occupies in a turn, separate from forward movement. The only square he may capture and move simultaneously to is when moving diagonally.

It will be understood that each of the elements described above, or two or more together, may also find a useful application in other types of constructions differing from the type described above.

While the invention has been illustrated and described as embodied in a checkerboard gameboard, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A multi-tiered checkered gameboard having at least one ROW and at least one column of column, comprising:

(a) a first tier, including at least one ROW and at least one column, of equally sized squares said equally sized squares alternating in color from clear to tinted;

(b) a second tier having a center with a hole and being displaced a distance above said first tier, and including at least one ROW and at least one column, of equally sized squares said equally sized squares alternating in said color from said clear to said tinted;

(c) a third tier having said center with said hole and being displaced said distance above said second tier, and including at least one ROW and at least one column, of equally sized squares said equally sized squares alternating in said color from said clear to said tinted; and (d) a fourth tier displaced said distance above said third tier, and including one square, said square being said color of clear means for displacing said tiers comprising three cylindrically shaped telescopic displacement rods which include a lower rod, said lower rod is affixed to said center of said lower tier by a fastener, said intermediate rod passes through said center hole in said second tier and passes through said cylindrical hole if said lower rod, said upper rod passes through said center hole in said third tier and passes through said cylindrical hole of said intermediate rod, wherein the rods are telescopically attached to each other.

2. A gameboard as defined in claim 1, wherein said upper rod is affixed to said center of said upper tier, by a fastener.

3. A gameboard as defined in claim 2, wherein said fastener is a screw or the like.

4. A gameboard as defined in claim 3, wherein said first tier, said second tier, said third tier, and said fourth tier are all parallel to each other as they remain attached to said central telescopic displacement rod.

5. A gameboard as defined in claim 4, wherein said first tier, said second tier, said third tier, and said fourth tier can be taken from the group consisting of at least acrylic, glass, plastic, wood, or any know solid element known to man.

6. A gameboard as defined in claim 5, wherein half of said squares are colored.

7. A gameboard as defined in claim 6, wherein said tinted squares are silk screened, sprayed, etched or the like known in the art.

8. A gameboard as defined in claim 7, wherein said cylindrical central displacement rod is acrylic or the like.

* * * * *